US010251803B2

(12) United States Patent
Valdez

(10) Patent No.: US 10,251,803 B2
(45) Date of Patent: Apr. 9, 2019

(54) SHOULDER REHABILITATION DEVICE AND METHOD OF USE

(71) Applicant: The Board of Regents of the University of Texas System, Austin, TX (US)

(72) Inventor: Abraham Valdez, San Antonio, TX (US)

(73) Assignee: THE BOARD OF REGENTS OF THE UNIVERSITY OF TEXAS SYSTEM, Austin, TX (US)

( * ) Notice: Subject to any disclaimer, the term of this patent is extended or adjusted under 35 U.S.C. 154(b) by 0 days.

(21) Appl. No.: 13/874,331

(22) Filed: Apr. 30, 2013

(65) Prior Publication Data

US 2013/0284182 A1 Oct. 31, 2013

Related U.S. Application Data

(60) Provisional application No. 61/640,650, filed on Apr. 30, 2012.

(51) Int. Cl.

| | |
|---|---|
| ***A61H 1/02*** | (2006.01) |
| ***A63B 21/00*** | (2006.01) |
| ***A63B 23/12*** | (2006.01) |
| ***A63B 21/012*** | (2006.01) |
| ***A63B 21/062*** | (2006.01) |
| ***A63B 23/035*** | (2006.01) |

(52) U.S. Cl.

CPC ..... *A61H 1/0281* (2013.01); *A63B 21/0628* (2015.10); *A63B 21/4045* (2015.10); *A63B 23/1245* (2013.01); *A63B 21/012* (2013.01); *A63B 21/4035* (2015.10); *A63B 23/03508* (2013.01)

(58) Field of Classification Search

CPC ..... A63H 11/00; A63H 15/00; A63H 15/02; A63H 17/00; A63H 19/00; A63H 19/30; A63H 19/36; A63H 21/00; A63H 21/02; G09B 19/00; G09B 19/02; A63B 21/00; A63B 21/06; A63B 21/0611; A63B 221/0613

USPC ..... 128/845; 446/489; 434/203, 258; 482/93, 114, 118

See application file for complete search history.

(56) References Cited

U.S. PATENT DOCUMENTS

| | | | | | |
|---|---|---|---|---|---|
| D149,083 | S | * | 3/1948 | Mooney | D18/6 |
| 2,708,797 | A | * | 5/1955 | Hamer | 434/203 |
| 3,581,408 | A | * | 6/1971 | Mohier | A63F 9/0876 273/441 |
| 3,952,424 | A | * | 4/1976 | Herr | G09B 11/00 434/162 |

(Continued)

*Primary Examiner* — Tarla R Patel

(74) *Attorney, Agent, or Firm* — Smith, Gambrell & Russell, LLP

(57) ABSTRACT

A device and method of use for a portable lightweight shoulder rehabilitation device that helps prevent shoulder injuries, helps recovery from shoulder injuries, increases shoulder flexibility, and provides strengthening of the shoulder. In one embodiment, the device is comprised of a base having at least one hand grip coupled to at least one guiding path rail to provide the desired movement of the hand and arm to target the shoulder for the desired activity such as warming up, flexibility, strengthening, and/or recovery. In another embodiment, the guiding path rail is comprised of tubing in a vertical semi-circle shape.

10 Claims, 4 Drawing Sheets

(56) References Cited

U.S. PATENT DOCUMENTS

| | | | | | |
|---|---|---|---|---|---|
| D309,165 | S | * | 7/1990 | Kaplan et al. | D21/468 |
| D324,698 | S | * | 3/1992 | Bruns | D19/25 |
| 5,133,684 | A | * | 7/1992 | Rhodes | A63H 33/00 248/153 |
| 5,163,451 | A | | 11/1992 | Grellas | |
| 5,195,542 | A | | 3/1993 | Gazielly et al. | |
| D349,310 | S | * | 8/1994 | Sundberg | D21/476 |
| 5,928,054 | A | * | 7/1999 | Mast | A47D 15/003 446/227 |
| 6,702,643 | B1 | * | 3/2004 | Drosendahl | A63H 33/006 446/175 |
| D719,220 | S | * | 12/2014 | Chase et al. | D21/468 |
| 2004/0266312 | A1 | * | 12/2004 | Oren | A45D 42/16 446/227 |
| 2009/0111351 | A1 | * | 4/2009 | Krochak et al. | 446/137 |

* cited by examiner

SHOULDER REHABILITATION DEVICE AND METHOD OF USE

CROSS-REFERENCE TO RELATED APPLICATIONS

This application claims the benefit under Title 35 United States Code § 119(e) of U.S. Provisional Patent Application Ser. No. 61/640,650; Filed: Apr. 30, 2012, the full disclosure of which is incorporated herein by reference.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATING-BY-REFERENCE OF MATERIAL SUBMITTED ON A COMPACT DISC

Not applicable

SEQUENCE LISTING

Not applicable

FIELD OF THE INVENTION

The present invention relates to a device and method of use for a shoulder rehabilitation device. More specifically, the present invention relates to a device and method of use for a portable lightweight shoulder rehabilitation device that helps prevent shoulder injuries, helps recovery from shoulder injuries, increases shoulder flexibility, and provides strengthening of the shoulder.

BACKGROUND OF THE INVENTION

Without limiting the scope of the disclosed device and method, the background is described in connection with a novel device and approach to efficiently and effectively strengthen and rehabilitate the shoulder as well as help prevent shoulder injuries.

The field's prior art reflects many approaches and devices in providing a means for shoulder rehabilitation that has become very important. According to a Center of Disease Control report released in 2006, one out of ten adults surveyed experienced shoulder pain in the past thirty days. And according to the American Academy of Orthopaedic Surgeons, in 2006 almost 7.5 million visits were made to physicians for shoulder problems. Shoulder rehabilitation, strengthening, and flexibility exercises are very beneficial in the treatment of many common causes of shoulder pain and injuries. Shoulder rehabilitation focuses on flexibility and strength. One area of shoulder rehabilitation that is difficult to target and that many approaches and devices miss is the rehabilitation of the rotator cuff. The rotator cuff is the group of muscles and tendons that surround the shoulder joint. Injuries to the rotator cuff are the most common cause of shoulder pain. The rotator cuff muscles can be exercised with little or no weights.

A first example of a rehabilitation device in the prior art is described in U.S. Pat. No. 5,163,451 issued on Nov. 17, 1992 to Demosthenes Grellas. In this example, the device comprises a fully adjustable chair, telescoping arm, and vertical stand. In this prior art, the device utilizes many structural components to achieve the rehabilitative activities. All of these components add weight, complexity of operation, cost, and is not easily transportable. In addition, this device targets many areas of an extremity for flexion and tension.

A second example of a rehabilitative device in the prior art is described in U.S. Pat. No. 5,195,542 issued on Mar. 23, 1993 to Dominique Gaziely et al. In this example, the device is directed to a rotator cuff reinforcement device for surgical implantation to a shoulder of a person, including a strip having components for fixation to segments of the rotator cuff. While serving its purpose, this approach is invasive and costly to the person.

In reality, a large, complicated, and heavy device severely limits the effectiveness of the device and thus hinders obtaining effective and efficient shoulder rehabilitation under various environments. In addition, intrusive and expensive approaches are not as effective and efficient as well.

While all of the aforementioned devices may fulfill their unique purposes, none of them fulfill the need for a practical and effective means for a shoulder rehabilitation device.

The present invention therefore proposes a novel device and method of use for a portable lightweight shoulder rehabilitation device that helps prevent shoulder injuries, helps recovery from shoulder injuries, increases shoulder flexibility, and provides strengthening of the shoulder.

BRIEF SUMMARY OF THE INVENTION

The present invention, therefore, provides a device and method of use for a shoulder rehabilitation device.

In one embodiment, the device is comprised of a base having at least one hand grip coupled to at least one guided path rail to provide the desired movement of the hand and arm to target the shoulder for the desired activity such as warming up, strengthening, and/or recovery. The hand grip moves along the guiding path rails. In another embodiment, the guiding path rail is comprised of tubing in a vertical semi-circle shape. In yet another embodiment, the hand grips may be of various weights to further facilitate in the warming up, strengthening, and/or recovery of the shoulder.

In summary, the present invention discloses an improved device and method of use for a shoulder rehabilitation device. More specifically, the present invention relates to a device and method of use for a portable lightweight shoulder rehabilitation device that helps prevent shoulder injuries, helps recovery from shoulder injuries, increases shoulder flexibility, and provides strengthening of the shoulder.

BRIEF DESCRIPTION OF THE SEVERAL VIEWS OF THE DRAWINGS

For a more complete understanding of the features and advantages of the present invention, reference is now made to the detailed description of the invention along with the accompanying figures in which.

DETAILED DESCRIPTION OF THE INVENTION

Disclosed herein is an improved device and method of use for a shoulder rehabilitation device. The numerous innovative teachings of the present invention will be described with particular reference to several embodiments (by way of example, and not of limitation).

Figure 1:
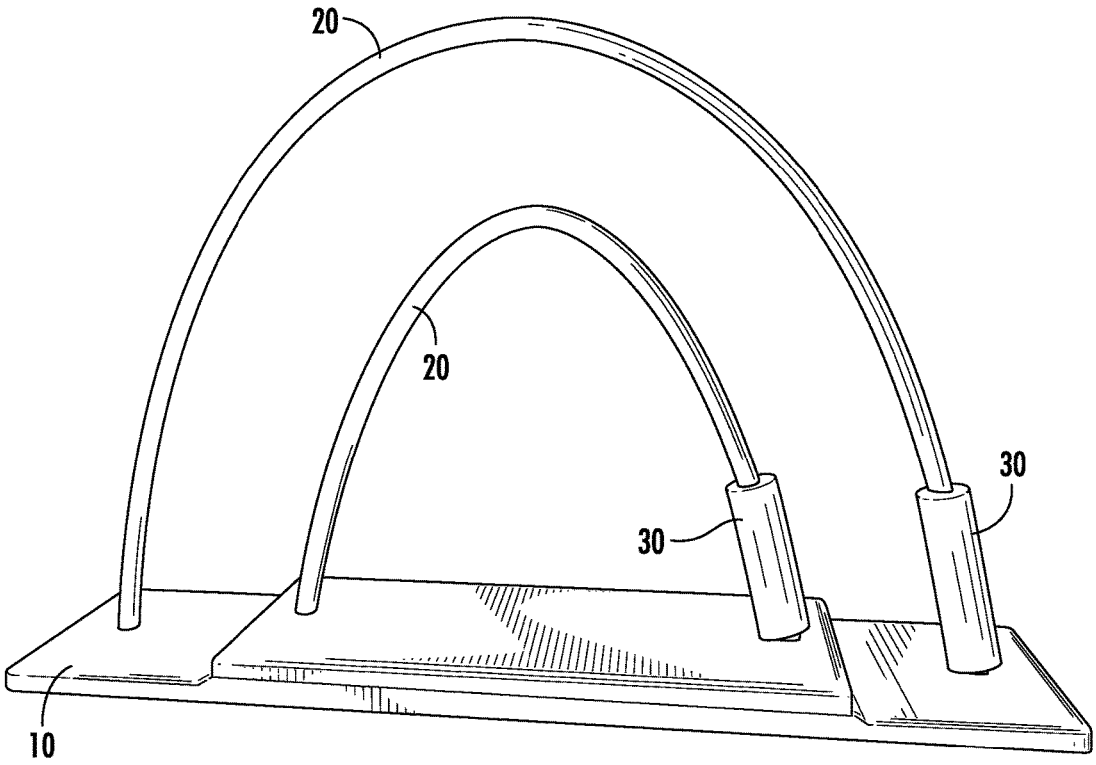
FIG. 1 is a front perspective view of the shoulder rehabilitation device in accordance with embodiments of the disclosure.

Reference is first made to FIG. 1, a front perspective view of the shoulder rehabilitation device. In this illustration the components of the device are shown. The device is comprised of a base 10, guiding path rails 20, and hand grips 30. The base 10 provides support for the guiding path rails 20 and may be constructed of various shapes, sizes, and materials to accommodate the range of paths taken by the guiding path rails 20. Ideally, the base 10 will be flat to the surface it rests on and will not allow the device to have any unintended motions during operation. The guiding path rails 20 in this illustration take on a semi cone shape and in this embodiment there are two guiding path rails 20. In this illustration the guiding path rails 20 are tubes having a diameter of about one inch with the inner guiding path rail 20 being about one foot apart at the base 10 connections and the outer guiding path rails 20 being about two feet apart at the base connections. The inner guiding path rail 20 has a maximum height of about one foot and the outer guiding path rail 20 has a maximum height of about two feet. In one embodiment the guiding path rails 20 are made of a polymer for lightweight and low cost. One skilled in the art can appreciate the variations that the guiding path rails 20 can take to achieve desired movements of the hand and arm to target various areas of the shoulder. For example, side to side and twisting motions can be achieved based on the configuration. The guiding path rails 20 may be made of a rigid material or a flexible material to help facilitate on the spot modification of exercises. In addition, variations in width and height in the provided above dimensions can be made to adjust for various individual sizes. The hand grips 30 can be constructed of various shapes, sizes, and materials. In one embodiment, the hand grips are made of a foam for lightweight and low cost. Their purpose is to provide a gripping handle that slides along the guiding path rails which in turn provides for a controlled movement to provide a prescribed method of exercise or motion for the individual's shoulder rehabilitation. The resistance of the motion may be increased by a number of means such as the hand grips 30 being made a certain weight or resistance being applied by the hand grips 30 tightness or friction against the guiding path rails 20. In addition, as shown in this illustration, the semi cone shape of the guiding path rails 20 provides for increased resistance at the top of the semi cone due to its shape and the shape of the hand grips 30. That is, the shapes of the two components, guiding path rails 20 and hand grips 30, are designed to provide variable resistance along the path of operation. The hand grip 30 length and the guiding path rail's 20 cone curvature near the top are such that the components interact through increased friction from the components rubbing against each other. One additional benefit of this invention is that the motions provided targets the rotator cuff that most other devices fail to target. Most other devices only target the posterior and interior portion of the shoulder while this device targets those areas as well as the rotator cuff. In addition, most other devices utilize gravity for their operation and the claimed device utilizes guided motion for its operation. As can be readily seen, the device can be used by athletes as a warm up to help prevent shoulder injuries, to strength train and rehabilitate the shoulder, and to increase the flexibility of the shoulder.

Figure 2:
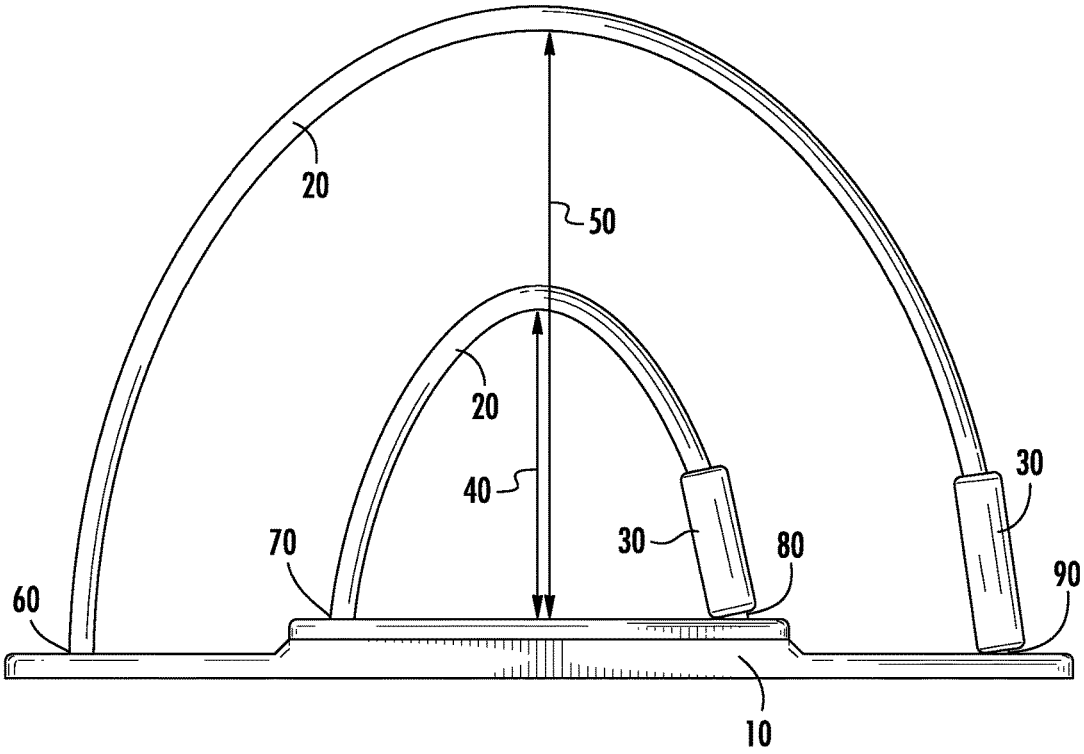
FIG. 2 is a front view of the shoulder rehabilitation device in accordance with embodiments of the disclosure.

Reference is next made to FIG. 2, a front view of the shoulder rehabilitation device. In this illustration the hand grips 30 are both on the right side of the shoulder rehabilitation device. An example operation of the device is having the individual hold onto the hand grip 30 coupled to the inner guiding path rail 20 with their right hand and with their right arm almost fully extended with a slight bend at the elbow and then sliding the hand grip 30 along the guiding path rail 20 to the left side until the hand grip 30 reaches the end of the guiding path rail 20 and then sliding the hand grip 30 back along the guiding path rail 20 back to the start position. This movement can be repeated for a number of repetitions over a time duration. As stated in FIG. 1, in one embodiment, the inner guide path rail 20 has a maximum height 40 of about one foot and the outer guide path rail 20 has a maximum height of about two feet 50. The inner guide path rail left base connection 70 and the inner guide path rail right base connection 80 are the end points or connection points of where the guide path rail is coupled to the base. The outer guide path rail left base connection 60 and the outer guide path rail right base connection 90 are the end points or connection points of where the guide path rail is coupled to the base.

Figure 3:
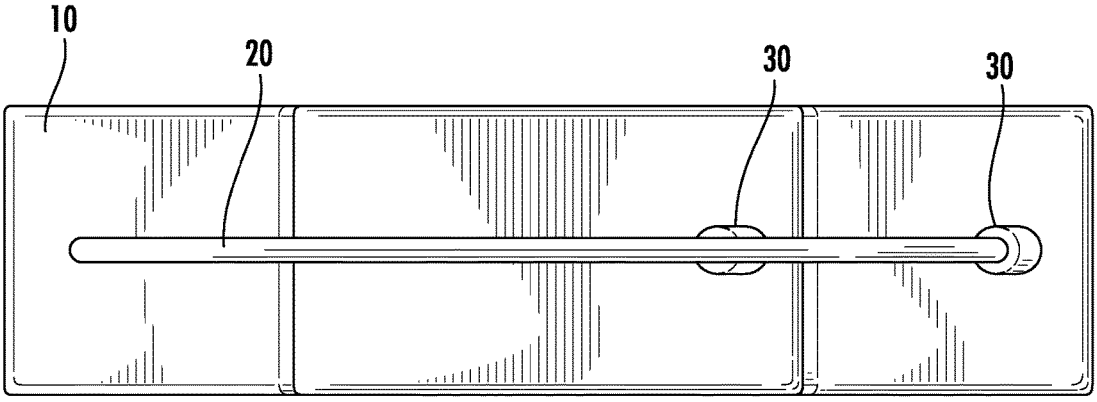
FIG. 3 is a top view of the shoulder rehabilitation device in accordance with embodiments of the disclosure.

Reference is now made to FIG. 3, a top view of the shoulder rehabilitation device. In this illustration the portability of device is shown. Based on the materials utilized and dimensions used in construction, the device is very lightweight and not very obtrusive.

Figure 4:
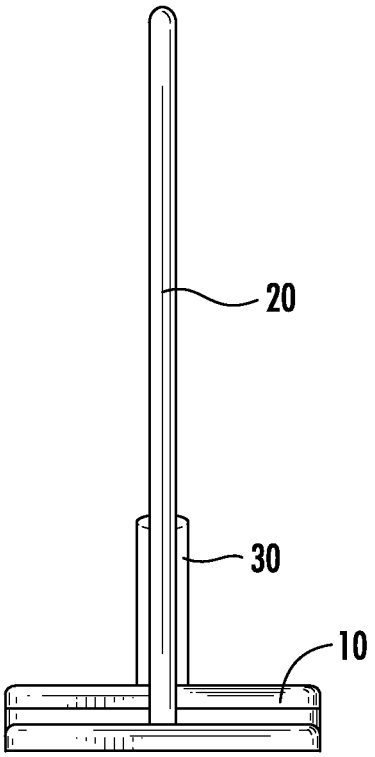
FIG. 4 is a left view of the shoulder rehabilitation device in accordance with embodiments of the disclosure.
Figure 5:
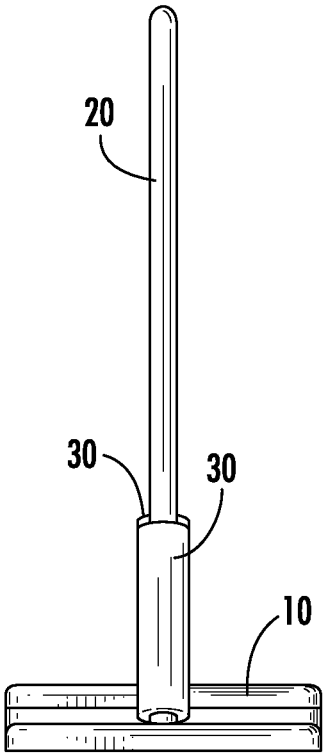
FIG. 5 is a right view of the shoulder rehabilitation device in accordance with embodiments of the disclosure.

Reference is now made to FIG. 4 and FIG. 5, a left and right view respectively of the shoulder rehabilitation device. In this illustration the portability of the device is again showcased.

In brief, the present invention relates to a device and method of use for a portable lightweight shoulder rehabilitation device that helps prevent shoulder injuries, helps recovery from shoulder injuries, increases shoulder flexibility, and provides strengthening of the shoulder.

The disclosed device and method of use is generally described, with examples incorporated as particular embodiments of the invention and to demonstrate the practice and advantages thereof. It is understood that the examples are given by way of illustration and are not intended to limit the specification or the claims in any manner.

To facilitate the understanding of this invention, a number of terms may be defined below. Terms defined herein have meanings as commonly understood by a person of ordinary skill in the areas relevant to the present invention. Terms such as "a", "an", and "the" are not intended to refer to only a singular entity, but include the general class of which a specific example may be used for illustration. The terminology herein is used to describe specific embodiments of the invention, but their usage does not delimit the disclosed device or method, except as may be outlined in the claims.

Alternative applications for this invention include using this device and method of use for obtaining shoulder movements for additional applications and in various types of machines. Consequently, any embodiments comprising a one piece or multi piece device having the structures as herein disclosed with similar function shall fall into the coverage of claims of the present invention and shall lack the novelty and inventive step criteria.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific device and method of use described herein. Such equivalents are considered to be within the scope of this invention and are covered by the claims.

All publications and patent applications mentioned in the specification are indicative of the level of those skilled in the art to which this invention pertains. All publications and patent application are herein incorporated by reference to the same extent as if each individual publication or patent application was specifically and individually indicated to be incorporated by reference.

In the claims, all transitional phrases such as "comprising," "including," "carrying," "having," "containing," "involving," and the like are to be understood to be open-ended, i.e., to mean including but not limited to. Only the transitional phrases "consisting of" and "consisting essentially of," respectively, shall be closed or semi-closed transitional phrases.

The device and/or methods disclosed and claimed herein can be made and executed without undue experimentation in light of the present disclosure. While the device and methods of this invention have been described in terms of preferred embodiments, it will be apparent to those skilled in the art that variations may be applied to the device and/or methods and in the steps or in the sequence of steps of the method described herein without departing from the concept, spirit, and scope of the invention.

More specifically, it will be apparent that certain components, which are both shape and material related, may be substituted for the components described herein while the same or similar results would be achieved. All such similar substitutes and modifications apparent to those skilled in the art are deemed to be within the spirit, scope, and concept of the invention as defined by the appended claims.

What is claimed is:

1. A shoulder rehabilitation device comprising:

a base member;

a guide path rail member having a first end point and a second end point, said first and second end points being coupled to said base member; and a hand grip member having a body with an outer gripping surface and an orifice, the orifice extending from a first opening in said body to a second opening in said body, said guide path rail member extending through said orifice such that said hand grip member is slidably mounted on said guide path rail member, wherein said orifice of said hand grip member has an inner perimeter that is substantially the same in shape and size as an outer perimeter of said guide path rail member such that said inner perimeter of said orifice remains in constant contact with said outer perimeter of said guide path rail member when slidingly traversing said hand grip member along a length of said guide path rail member, said constant contact between said inner perimeter of said orifice and said outer perimeter of said guide path rail member is such to generate a frictional force between said hand grip member and said guide path rail member that presents a resistance to slidingly traversing said hand grip member along said guide path rail member, and said guide path rail member provides a path having a curvature that presents further resistance to slidingly traversing said hand grip member along said guide path rail member, said curvature being a variable cone curvature that presents a variable resistance along said path of said guide path rail member, said variable resistance being greatest at a top of said cone curvature.

2. A shoulder rehabilitation device according to claim 1, comprising two or more guide path rail members.

3. A shoulder rehabilitation device according to claim 2, wherein said two or more guide path rail members extend along a common vertical plane.

4. A shoulder rehabilitation device according to claim 2, wherein said two or more guide path rail members are made of a flexible material configured to enable a user to reshape said guide path rail members.

5. A shoulder rehabilitation device according to claim 2, wherein each of said two or more guide path rail members has a first end point and a second endpoint, each of said first and second end points being coupled to said base member, and each of said two or more guide path rail members extends along a common vertical plane.

6. A shoulder rehabilitation device according to claim 2, wherein each of said two or more guide path rail members has a first end point and a second endpoint, each of said first and second end points being coupled to said base member, each of said two or more guide path rail members extends along a common vertical plane, and each of said two or more guide path rail members is tubular, and each of said two or more guide path rail members provides a semi-circular path.

7. A shoulder rehabilitation device according to claim 1, wherein said guide path rail member is tubular.

8. A shoulder rehabilitation device according to claim 1, wherein said guide path rail member provides a semi-circular path.

9. A shoulder rehabilitation device according to claim 1, wherein said hand grip member is weighted.

10. A shoulder rehabilitation device according to claim 1, wherein said inner perimeter of orifice remains in constant contact with said outer perimeter of said guide path rail member when slidingly traversing said hand grip member along the entire length of said guide path rail member.

* * * * *